US005309134A

United States Patent [19]

Ridge

[11] Patent Number: 5,309,134

[45] Date of Patent: May 3, 1994

[54] SENSOR WITH SLOPED TERMINATION FOR REDUCED ELEMENT BEND

[75] Inventor: Larry D. Ridge, West Henrietta, N.Y.

[73] Assignee: CTS Corporation, Elkhart, Ind.

[21] Appl. No.: 961,247

[22] Filed: Oct. 15, 1992

[51] Int. Cl.[5] ..... H01C 3/06; H01C 10/32

[52] U.S. Cl. ..... 338/210; 338/211; 338/162; 338/165

[58] Field of Search ..... 338/210, 165, 211, 162, 338/172, 174, 160, 162, 258

[56] References Cited

U.S. PATENT DOCUMENTS 3,457,537 7/1969 Hines ..... 338/162
4,355,293 10/1982 Driscoll ..... 338/184
4,430,634 2/1984 Hufford et al. ..... 338/164
4,435,691 3/1984 Ginn ..... 338/176

*Primary Examiner*—Marvin M. Lateef
*Attorney, Agent, or Firm*—Albert W. Watkins

[57] ABSTRACT

A Kapton element is terminated by bringing an element which is wrapped at a substantially fixed radius from a rotor out through a linear portion to the terminations. This causes the terminations to be at an angle to the line between the electrical connector and the rotor. A standard termination is then made without the need to bend a sharp turn in the Kapton element—an advantage that is more significant as the bend radius is increased for tighter package sizing. This concept also offers improved assembly, reducing the effort to automate production.

2 Claims, 1 Drawing Sheet

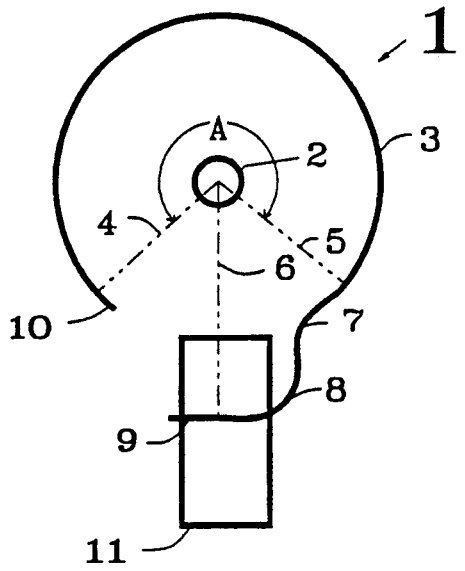
PRIOR ART FIG. 1
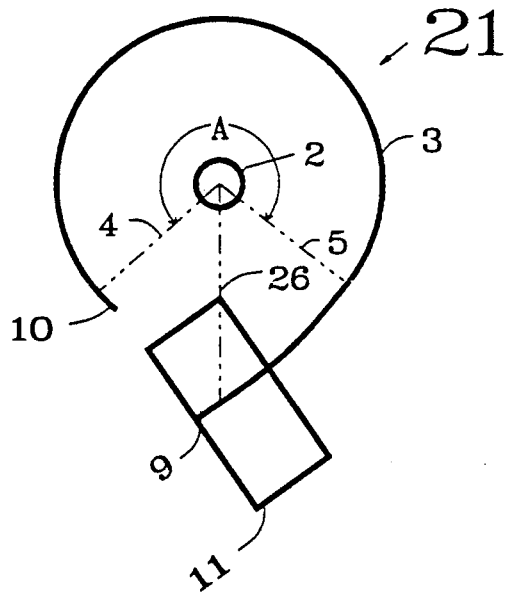
FIGURE 2

SENSOR WITH SLOPED TERMINATION FOR REDUCED ELEMENT BEND

BACKGROUND OF THE INVENTION

1. Field of the Invention

This invention pertains to electrical resistors generally, and specifically to mechanically variable resistors with flexible elements and associated termination structure.

2. Description of the Related Art

As evidenced by the explosion of micro-machined silicon, there is a continuing trend to smaller components that deliver the same or better performance than larger predecessors. This is true in the sensor industry as much as in any other. However, in the prior art to date, there have been factors that tend to limit the minimum achievable size of variable resistor type position sensors. The limitations are particularly acute where flexible elements are incorporated into the package.

In the prior art and in common use today there are many variable resistor configurations. Many of those accommodate flexible elements within a housing or other structure. Exemplary of prior art package designs is U.S. Pat. No. 4,355,293 by Driscoll incorporated herein by reference. A number of additional patents also illustrate flexible elements. Among these are U.S. Pat. Nos. 4,430,634 and 4,435,691 assigned to the assignee of the present invention and also incorporated herein by reference. Each of these prior art patents illustrate an element that is flexible and retained in position by the package and termination. The element is wrapped in a generally cylindrical configuration, concentric about the rotor or generally cylindrical or rod shaped actuator. The element may form an arc or may form a nearly complete 360 degree radius about the rotor structure.

As noted, somewhere within that flexible structure exist terminations. In the case of position sensors of the type pertaining to this invention, there will be a minimum of two terminations, but more typically three or more. Some sensors have been known to incorporate a dozen or more film terminations. Two of the terminations are typically at fixed locations on the film and a variable contactor traversing electrically therebetween may be used to connect to a third termination. Aforementioned U.S. Pat. No. 4,435,691 is illustrative of one pattern and contactor arrangement.

In order to accommodate the necessary two fixed terminations the prior art has come to depend upon terminations either at one or both extremes of the flexible element. The use of terminations at both ends has proven disadvantageous, since the electrical connection must still be routed to bring both terminations together. In the referenced patent to Driscoll, the electrical terminations are each of unique geometry and so must be tooled with unique tools. The high cost of tooling has made this an impractical approach for most applications. Further, where materials and temperatures thereof are not always the same, any differences in expansion may result in undue forces being generated in the film and at the terminations. Such forces are certainly undesirable and may lead to immediate disconnection or slower cycled failures.

While routing is still practiced as Driscoll illustrates, more typically the electrical routing is performed directly upon the flexible substrate that carries the resistance element. This is particularly simplified where a material such as Kapton TM is used as a flexible substrate material. The resistor structure is then formed by screen printing, stenciling or other similar process upon a portion of the film. A conductor may also be patterned upon a separate portion of the film to bring the terminations to a common end of the film. Polyimides, polyesters and other various materials are in use as flexible substrate material.

The use of conductors to route to a common termination simplifies installation of the element, since only one end of the film must be captured to perform the termination. Furthermore, the terminations are then exactly positioned in very precise relation. The precision of the relative position between the terminations may be limited only by the precision of the patterning process.

The termination structure and film require alignment therebetween. This is typically achieved through some type of design features built into the envelope surrounding the flexible element. In addition, the terminations and the flexible element are of finite dimension. Each of the features incorporated to capture the element and the terminations consume additional space that forces the package size to larger dimensions.

In the specific case of a rotary variable resistor, the resistor element is typically terminated along an axis extending radially from and perpendicular to the rotor. To avoid using individually tooled terminations such as illustrated in Driscoll, the element is wrapped around the rotor and then bent first away from the rotor axis and then sharply curved back essentially tangential to circular dimension formed by the bulk of the element.

FIG. 1 illustrates on such prior art film type variable resistor. For the purposes of this disclosure, all extraneous or non-specific details have been removed for ease of description and clarity. Details of cooperative features are easily identified within the cited prior art including U.S. Pat. Nos. 4,355,293, 4,430,634, 4,435,691 and the millions of similar sensors already in widespread application in automobiles and other machinery and equipment.

The sensor is generally identified by the numeral 1. A film 3 is illustrated as generally surrounding a rotor structure 2. The film is typically formed from Kapton and, when laid flat, takes a rectangular shape. U.S. Pat. No. 4,435,691 illustrates one example of the film as it would appear laid flat.

The film 3 has two extreme ends 10 and 9, with appropriate resistive and conductive material patterned therebetween. Electrical connections to the film are made at end 9, somewhere between the edge of the film and a bend 8 in the film, illustrated generally by outline 11. The connections may be made by solder, conductive adhesive, pressure wedges, wire bonding or other suitable technique, and typically lead to an electrical connector or pigtail and electrical connector.

Film 3 must travel from the termination end 9 to a sensor region. In the illustration of FIG. 1, this sensor region may exist from 15 line 4 through angle A to line 5. In the illustration, angle A approximates 270 degrees of rotation. It should be understood that this angle may be more or less, depending upon the particular application. Within this sensor region limited by angle A the element 3 is maintained at substantially fixed radial distance. For example, radial lines 4 and 5 will be of very similar length.

The termination structure and associated housing occupy some of the space between the rotor and termination 9, necessitating a pair of bends 7 and 8 in film 3 so that no obstructions exist between rotor 2 and associated sliding contact structure (not illustrated) and termination region 9 and associated housing and electrical terminations 11.

The two bends 7 and 8 are detrimental to film 3. As noted, there exists a pattern of resistor(s) and conductor(s) upon film 3. Bending may lead to cracking or separation within those films and a resultant failure of the device. Where the radius of bend is minor, as it is through angle A, there is no risk of damage to the conductive pattern. However, where sharp bends are required, as at bends 7 and 8, the number of failures is increased undesirably. Additionally, insertion of film 3 into a housing designed to retain film 3 is undesirably difficult, since the film must be carefully placed within guides in the housing to hold film 3 to the shape illustrated. This usually requires significant manual intervention, again affecting quality and cost undesirably. The present invention seeks to overcome these aforementioned limitations of the prior art through the use of a novel geometry and angle of termination.

SUMMARY OF THE INVENTION

According to the invention, within a rotary variable resistor a flexible element and termination are positioned to be off axis from a radial axis extending from a rotor structure. Positioning in this manner accommodates a smaller package structure without sacrificing performance. Additionally, quality is enhanced due to lesser damage to the element and automation may be more easily implemented since there are fewer intricate operation associated with element insertion.

BRIEF DESCRIPTION OF THE DRAWINGS

FIG. 1 illustrates a prior art sensor element and rotor in a schematic outline form.

FIG. 2 illustrates a sensor element and rotor in accord with the present invention in a schematic outline form.

DESCRIPTION OF THE PREFERRED EMBODIMENT

FIG. 2 schematically illustrates the preferred embodiment of the present invention. Numbering corresponds, where appropriate, to prior art FIG. 1.

The sensor of the present invention is generally identified by the numeral 21. A rotor 2, element 3 and other like numbered components are present as in the prior art. The element 3 of sensor 21 is positioned differently from the like element of sensor 1 so as to no longer include sharp bends 7 and 8. The straightening of element 3 is accompanied by a rotation of termination 11 to be off axis from a radial axis 26. The sensor element 3 captured by element 11 has a tangent not perpendicular to a radial axis 26.

By rotating the termination the sensor element 3 does not incorporate any sharp bends. The element is still terminated on a single end as in prior art FIG. 1, but the sensor 21 also forms a more compact package. This is of tremendous value in ultimate miniaturization, since prior art sensor 1 of FIG. 1 requires tighter and tighter bends 7 and 8 as the package is made smaller. No such restrictions exist in the present invention, allowing embodiments such as sensor 21 to be made far more compact than possible in the prior art. In fact, the tightest radius of curvature is within the sensor region subtended by angle A.

The present invention continues to offer the many advantages of the prior art flexible element sensors using only one end of the element 3 for termination and at the same time offers compact packaging while still allowing a nearly full rotation sensor.

The foregoing details what is felt to be the preferred embodiment of the invention. No material limitation to the scope of the claimed invention is intended. Further, features and design alternatives that would be obvious to one of ordinary skill in the art are considered to be incorporated herein. For example, one of ordinary skill in the field will immediately realize that many materials are available and satisfactory for the composition of the element 3 and include such materials a polyimides, polyamides, epoxies, urea-formaldehydes, phenolics, etc. The resistors and conductors may be formed from an equally large numbers of materials. The invention has utility where there exists a need or desire to reduce or control the bending radius of the element while still maintaining a compact package dimension. The scope of the invention is set forth and particularly described in the claims hereinbelow.

I claim:

1. A flexible element rotary variable resistor comprising:

a flexible element including a resistor;

off-axis termination means for electrically interconnecting said resistor to other electrical components;

a rotor means for rotating about a rotor axis and affecting a change in resistance between two of said terminations;

said element wrapped in a generally cylindrical configuration about said rotor axis at a first radial distance therefrom;

said terminations electrically interconnecting to said element at an extension of said element;

said extension having a tangent thereto, said tangent being non-perpendicular to a radial axis extending perpendicular to said rotor axis;

said termination structure and said extension of said element located from a second radial distance from said rotor axis and beyond said second radial distance, said second radial distance substantially similar to said first radial distance.

2. The resistor of claim 1 wherein said rotor means rotates about an angle less than 360 degrees, but reduced therefrom only by an amount sufficient to accommodate said termination structure immediately adjacent said extension.

* * * * *